US006436233B1

(12) United States Patent
Barrett et al.

(10) Patent No.: US 6,436,233 B1
(45) Date of Patent: Aug. 20, 2002

(54) FEEDING CELLULOSE MATERIAL TO A TREATMENT VESSEL

(75) Inventors: Mark D. Barrett, Queensbury; J. Robert Prough; C. Bertil Stromberg, both of Glens Falls, all of NY (US)

(73) Assignee: Andritz Inc., Glens Falls, NY (US)

( * ) Notice: Subject to any disclaimer, the term of this patent is extended or adjusted under 35 U.S.C. 154(b) by 0 days.

(21) Appl. No.: 09/573,046

(22) Filed: May 18, 2000

(51) Int. Cl.[7] ..... D21C 1/10; D21C 5/10; D21C 7/06; D21C 7/08

(52) U.S. Cl. ..... 162/52; 162/56; 162/236; 162/246; 162/17; 162/18; 162/57; 162/68; 162/242; 162/243

(58) Field of Search ..... 162/52, 56, 237, 162/246, 17, 18, 19, 57, 68, 242, 243

(56) References Cited

U.S. PATENT DOCUMENTS

| | | | | |
|---|---|---|---|---|
| 3,713,541 | A | | 1/1973 | Nelson |
| 4,259,150 | A | * | 3/1981 | Prough |
| 4,309,284 | A | | 1/1982 | Morimoto et al. |
| 4,885,090 | A | | 12/1989 | Chupka et al. |
| 4,958,741 | A | | 9/1990 | Johanson |
| 4,961,844 | A | | 10/1990 | Ekholm et al. |
| 5,236,285 | A | | 8/1993 | Prough |
| 5,236,286 | A | | 8/1993 | Prough |
| 5,401,361 | A | | 3/1995 | Prough et al. |
| 5,476,572 | A | | 12/1995 | Prough |
| 5,489,363 | A | | 2/1996 | Marcoccia et al. |
| 5,500,083 | A | | 3/1996 | Johanson |
| 5,536,366 | A | | 7/1996 | Marcoccia et al. |
| 5,547,012 | A | | 8/1996 | Marcoccia et al. |
| 5,575,890 | A | | 11/1996 | Prough et al. |
| 5,617,975 | A | | 4/1997 | Johanson et al. |
| 5,620,562 | A | | 4/1997 | Marcoccia et al. |
| 5,622,598 | A | | 4/1997 | Prough |
| 5,628,873 | A | | 5/1997 | Johanson et al. |
| 5,635,025 | A | | 6/1997 | Bilodeau |
| 5,635,026 | A | | 6/1997 | Kettunen et al. |
| 5,662,775 | A | | 9/1997 | Marcoccia et al. |
| 5,736,006 | A | | 4/1998 | Prough |
| 5,753,075 | A | * | 5/1998 | Stromberg et al. |
| 5,766,418 | A | | 6/1998 | Prough |
| 5,779,856 | A | | 7/1998 | Kettunen |
| 5,824,188 | A | | 10/1998 | Prough et al. |
| 5,849,150 | A | | 12/1998 | Marcoccia et al. |
| 5,849,151 | A | | 12/1998 | Marcoccia et al. |
| 5,958,181 | A | | 9/1999 | Stromberg et al. |
| 5,968,314 | A | | 10/1999 | Prough |
| 6,039,841 | A | | 3/2000 | Hernesniemi |

FOREIGN PATENT DOCUMENTS

| | | |
|---|---|---|
| WO | WO 96/26315 | 8/1996 |
| WO | WO 00/06282 | 2/2000 |

* cited by examiner

*Primary Examiner*—Stanley S. Silverman
*Assistant Examiner*—Mark Halpern
(74) *Attorney, Agent, or Firm*—Nixon & Vanderhye P.C.

(57) ABSTRACT

A feed system for a cellulose pulp treating vessel (such as a continuous digester) is not limited by the required L/W ratio of the pump feeding a wood chip slurry to a high pressure transfer device, the feed system may be kept at a low temperature to minimize flashing of liquid into steam, and a return conduit from the treatment vessel to the transfer device high pressure inlet may be eliminated. Some of the liquid is removed from the slurry just before the low pressure inlet to the transfer device, and/or just after the high pressure outlet, to reduce the L/W ratio of the slurry by at least 0.25, e.g. from 3.0:1 to 2.25:1 just before the low pressure inlet, and from 7.0:1 to 5.0:1 substantially immediately after the high pressure outlet.

21 Claims, 7 Drawing Sheets

FEEDING CELLULOSE MATERIAL TO A TREATMENT VESSEL

BACKGROUND AND SUMMARY OF THE INVENTION

U.S. Pat. Nos. 5,476,572; 5,622,598; 5,635,025; 5,766,418; and 5,968,314 disclose methods and devices for feeding a slurry of comminuted cellulosic fibrous material to a treatment vessel that have revolutionized the art of treating comminuted cellulosic fibrous material to produce cellulose pulp. The disclosed inventions, sold under the trademark LO-LEVEL® by Ahlstrom Machinery Inc., of Glens Falls, N.Y. employ one or more slurry-type pumps for treating and transferring comminuted cellulosic material to one or more treatment vessels. Not since the initial development of the continuous cooking process in the 1940s and 1950s have such dramatic improvements been made to equipment used to transfer material to a treatment vessel, for example, a continuous or batch digester. This is confirmed by the broad acceptance of this technology by the Pulping Industry.

The present invention introduces improvements to the systems and methods described in the above patents which further simplify and enhance the effectiveness of the methods and devices disclosed therein.

The prior art systems for introducing a slurry of comminuted cellulosic fibrous material, for example, as exemplified by the system disclosed in U.S. Pat. No. 5,476,572, use a two-stage pressurization and transfer of slurry. In the first stage, the slurry is pressurized to a first pressure and transferred to a high-pressure transfer device, such as, a High Pressure feeder designed and marketed by Ahlstrom Machinery. The first stage pressurization and transfer is typically performed using a specially-designed slurry pump which handles slurries of material and liquid. In the second stage the High Pressure Feeder pressurizes the slurry to a second pressure, higher than the first pressure, by exposing the material to a high pressure liquid stream, and transports the slurry to a treatment vessel, for example, a continuous or batch cellulose pulp digester. However, according to this prior art, the amount of cellulose material, such as, wood chips, that can be transferred to the High Pressure Feeder by the slurry pump, per unit volume of liquid, is limited by the capacity of the pump to transfer solid material.

Typically, the relative amount of liquid present in slurry is indicated by a "liquid-to-solids" ratio, or, in the case of transferring slurries of wood chips, a "liquid-to-chip" ratio, or, more specifically, a "liquor-to-wood" (L/W) ratio. The liquid-to-wood ratio is a dimensionless ratio of the volume of the liquid present in the slurry to the volume of the wood present in the slurry. Conventional High Pressure Feeders can accept slurries having L/W of below 3.0:1, typically even below 2.5:1. The lower limit of the L/W ratio of a slurry being introduced to a High Pressure Feeder is about 2.0:1. Note that a reduction in L/W ratio from 3.0:1 to 2.0:1 corresponds to a 25% reduction in the volume of liquid that must be accepted by the High Pressure Feeder, or a corresponding 25% increase in the volume of chips that can be processed by the High Pressure Feeder.

According to one aspect of the present invention, the volume of liquid that is transferred to the High-pressure Feeder is reduced so that more wood chips can be introduced and processed in the digester system being fed per revolution of the High Pressure Feeder. This aspect of the invention has the further advantage of allowing for the reduction in size of the High-pressure Feeder for a given project, or allowing for an increase in the capacity of a production-limited facility.

After introducing the slurry of chips to a high-pressure transfer device, for example, a High-Pressure Feeder sold by Ahlstrom Machinery, the slurry is displaced from the feeder by a flow of high-pressure liquid, typically at a pressure between about 5 and 15 bar gage, provided by a high-pressure pump. Typically this flushing of the slurry from the feeder by the liquid results in the slurry being propelled to a treatment vessel having a L/W ratio of between about 4.0:1 to 10.0:1, and is typically greater than 5:1, often greater than 7:1, sometimes greater than 9:1. For example, for a L/W ratio of 9:1, the volume of liquid present in the conduit transferring the slurry from the feeder to the treatment vessel, for example, to a pulping digester, the volume of liquid is 9 times the volume of the cellulose material, such as, wood chips. Typically, this volume of liquid is required in order to flush the chips from the pockets of the feeder. This relatively large volume of liquid requires a relatively large conduit in which to pass the slurry from the feeder to the digester and sufficient energy to propel the relatively large volume of liquid up to the top of the pressurized digester.

The L/W ratio of the slurry exiting the High Presser Feeder is also a function of the equipment which feeds the slurry to the feeder. In conventional, "suck through" systems typically having a pressurized chip chute the L/W ratio of the slurry introduced to the High Pressure Feeder is about 2.0–2.5:1. In "pump through" systems, such as Lo-Level Feed Systems sold by Ahlstrom Machinery, the L/W ratio of the slurry introduced to the High Pressure Feeder is about 3.0–3.5:1.

According to another embodiment of this invention, the liquid volume in the slurry transferred from the feeder to the treatment vessel is minimized by removing at least some of the liquid from the slurry after the slurry has been discharged from the feeder and before the slurry is introduced to the treatment vessel. One advantage of this embodiment of the invention is that, with reduced liquid volume, the diameter of the transfer conduit to the treatment vessel can be reduced. Reducing the size of this conduit has the further advantage of reducing the sizes, and hence the cost, of the associated valves and instruments that are located in this conduit.

The above embodiment of this invention is particularly effective in limiting the amount of heat returned to the feed system from the treatment vessel, for example, via what is known as the "Top Circulation" or "TC" line. As recognized in the art, exposing the feed system, for example, the High-pressure Feeder, to liquids having temperatures at or above 100° C. can cause flash-evaporation of this liquid (known as "flashing") when the liquids are exposed to the atmospheric pressures present in the vicinity of the high-pressure feeder. However, when excess liquid is removed from the slurry when introducing the slurry to the treatment vessel, for example, by using of a Top Separator, heat present in the treatment vessel can migrate, for example, by convection, to the vicinity of the Top Separator and be drawn out of the vessel with the removal of liquid from the Top Separator. This heat can raise the temperature of the liquid returned to the feed system via the TC line. This increased TC line temperature can cause flashing and vibration in the feed system and interfere with the normal operation of the feed system.

One way of reducing the potential of returning undesirable heat to the feed system is by limiting the flow of liquid removed from the slurry as the slurry is introduced to the treatment vessel. According to this embodiment of the invention, a liquor removal device is located in the conduit which feeds the slurry to the treatment vessel, preferably, near to or adjacent the inlet of the treatment vessel. At least some liquid is removed from the slurry using this device and returned to the feed system such that less liquid needs to be removed from the slurry as the slurry is introduced to the vessel. This reduced removal of liquid from the vessel reduces the potential for heat in the vessel to be withdrawn with the removed liquor and returned to the feed system.

One embodiment of this invention is a method of feeding a slurry of comminuted cellulosic fibrous material to a treatment vessel comprising or consisting of: a) slurrying the material with a slurrying liquid to produce a slurry of material and liquid having a first liquid-to-material volume ratio; b) pressurizing the slurry to a first pressure and transferring the slurry to a high-pressure transfer device; c) introducing the slurry to the high-pressure transfer device; d) in the high-pressure transfer device, pressurizing the slurry to a second pressure, higher than the first pressure; e) transferring the slurry from the high-pressure transfer device to the treatment vessel; f) introducing the pressurized slurry to the treatment vessel; and g) removing at least some of the liquid from the slurry between a) and c) so that the slurry introduced to the high-pressure transfer device in c) has a second liquid-to-material ratio lower than the first ratio. In a preferred embodiment, at least some of the liquid removed during step g) is used as at least some of the slurrying liquid of step a). Preferably g) is performed immediately prior to c), but f) may be performed at any time after a).

The present invention also may further include h) treating the material in the treatment vessel to produce cellulose pulp, for example, by a continuous or non-continuous (that is batch) chemical pulping process. For example, those processes disclosed in U.S. Pat. Nos. 5,489,363; 5,536,366; 5,547,012; 5,575,890; 5,620,562; 5,662,775; 5,824,188; 5,849,150; and 5,849,151 and marketed by Ahlstrom Machinery under the trademark LO-SOLIDS®.

The first liquid-to-material volume ratio is used in slurrying the material in a) is typically greater than 2.75:1, preferably about 2.75 to 3.25 to 1.0. This ratio is typically required in order for the slurry pump, for example, a Hidrostal® screw-type-impeller slurry pump manufactured by Wemco of Salt Lake City, Utah, or a pump provided by Lawrence Pumps Inc. of Lawrence, Mass. to operate properly. Though for other types of slurry pumps this L/W ratio may even be lower, for example, 2.50:1 or less. The second liquid-to-material ratio (that is, the ratio for the slurry introduced to the high-pressure feeder) is preferably about 2.50:1 or less, preferably about 1.75 to 2.25:1, or even less than about 1.75:1. In a preferred embodiment of this invention the second L/W ratio is at least 0.25 less than said first liquid-to-material ratio, most preferably at least 0.50 less than said first liquid-to-material ratio.

The first pressure to which the slurry is pressurized typically is in the range of 1 to 7 bar gage; the second pressure is typically in the range of 5 to 15 bar gage.

The present invention also includes a system for feeding comminuted cellulosic fibrous material to a treatment vessel, comprising or consisting of: a first vessel containing a slurry of comminuted cellulosic fibrous material having a first liquid-to-material volume ratio; a high-pressure transfer device having a low-pressure inlet, a low-pressure outlet, a high-pressure inlet, and a high-pressure outlet connected to the treatment vessel; means for pressuring and transferring the slurry from the first vessel to the low-pressure inlet of the high-pressure transfer device; a means for removing at least some of the liquid from the slurry located between the pressurizing means and the low-pressure inlet to provide a slurry having a liquid-to-material ratio less than the first ratio; and a means for transferring the slurry from the high-pressure outlet to the treatment vessel.

The first vessel is preferably a Chip Chute or Chip Tube provided by Ahlstrom Machinery. The high-pressure transfer device is preferably a High-pressure Feeder as sold by Ahlstrom Machinery. The means for pressurizing and transferring the slurry to the high-pressure transfer device may be a chip pump for pumping the slurry into the high-pressure transfer device or a pump (for example, a pump known as a Chip Chute Circulation Pump) for drawing the slurry into the high-pressure transfer device, or any other suitable conventional pressurizing device. The means for removing liquid from the slurry is preferably a cylindrical device having a concentric cylindrical screen through which the slurry passes and from which liquid can be removed. One such device is an In-line Drainer sold by Ahlstrom Machinery. A means for transferring the slurry from the high-pressure outlet of the high-pressure transfer device preferably comprises a high-pressure pump that provides pressurized liquid to the high-pressure inlet of the high-pressure transfer device. The preferred liquid-to-material ratios and pressures are preferably as described above.

Another aspect of the invention comprises a method of feeding a slurry of comminuted cellulosic fibrous material to a treatment vessel comprising or consisting of: a) slurrying the material with a slurrying liquid to produce a slurry of material and liquid having a first liquid-to-material volume ratio; b) pressurizing the slurry to a first pressure and transferring the slurry to a high-pressure transfer device; c) introducing the slurry to the high-pressure transfer device; d) in the high-pressure transfer device, pressurizing the slurry to a second pressure, higher than the first pressure using a pressurized liquid and to produce a slurry of liquid having a second liquid-to-material volume ratio, higher than the first ratio; e) discharging the slurry having the second volume ratio from the high-pressure transfer device; f) transferring the slurry to the treatment vessel; g) introducing the pressurized slurry to the treatment vessel; and h) removing at least some of the liquid from the slurry between e) and g) so that the slurry introduced to the treatment vessel in g) has a third liquid-to-material ratio lower than the second ratio.

In a preferred embodiment, at least some of the liquid removed during h) is used as the pressurized slurrying liquid for d). In another preferred embodiment at least some of the liquid removed during h) is used as the slurrying liquid in a). Also h) is preferably performed immediately after e) but h) may be performed at any time after e) but before g). The present invention also may further include i) treating the material in the treatment vessel to produce cellulose pulp, for example, by a continuous or non-continuous, that is batch, chemical pulping process. For example, those processes disclosed in U.S. Pat. Nos. 5,489,363; 5,536,366; 5,547,012; 5,575,890; 5,620,562; 5,662,775; 5,824,188; 5,849,150; and 5,849,151 and marketed by Ahlstrom Machinery under the trademark LO-SOLIDS®. Also the method is preferably practiced to, between a) and c), remove some of the liquid from the slurry before the slurry is introduced into the high pressure device so that the slurry has a fourth liquid to material ratio at least about 0.25 less than the first ratio.

In one preferred embodiment of this invention, the above method is performed such that h) is practiced prior to g) so that a slurry having a third liquid-to-material ratio is introduced to the treatment vessel. This embodiment also preferably additionally includes i) removing excess liquid from the slurry during or shortly after the process of g), that is, while introducing the slurry to the treatment vessel, or shortly thereafter, and also j) combining the liquids removed at g) and i) and using at least some of the combined liquids as the pressurizing medium in d). Furthermore, j) preferably is practiced by monitoring the temperature of the combined liquids and regulating the flow of the liquids in h) and i) so that the temperature of the combined liquid is maintained below a specified value. The specified temperature value typically ranges from about 90 to 120° C. depending upon the prevailing pressure in the feed system.

The first liquid-to-material volume ratio is used in slurrying the material in a) is typically greater than 2.75:1, that is, about 2.75 to 3.25 to 1.0. This ratio is typically required in order for the slurry pump, for example, a Hidrostal® screw-type-impeller slurry pump manufactured by Wemco, to operate properly. For other types of slurry pumps this L/W ratio may even be lower, for example, 2.50:1 or less. The second liquid-to-material ratio is typically greater than 2.50:1, for example about 5.0:1 or greater, preferably about 7.0:1 or greater, or even 9.0:1 or greater. The third liquid-to-material ratio is typically at least about 0.25 less than the second liquid-to-material ratio, most preferably at least about 0.50 less than the second liquid-to-material ratio.

The first pressure to which the slurry is pressurized typically is in the range of 1 to 7 bar gage; the second pressure is typically in the range of 5 to 15 bar gage.

According to another aspect of the invention there is provided a cellulosic fibrous material treating system comprising: A material slurry vessel. A high pressure transfer device including a low pressure inlet, low pressure outlet, high pressure inlet and high pressure outlet. The slurrying vessel operatively connected to said low pressure inlet and outlet. A treatment vessel connected to the high pressure outlet. Means for removing some liquid from slurry moving between the high pressure outlet and treatment vessel and circulating the removed liquid to the high pressure inlet. And, the system devoid of a connection from the treatment vessel to the high pressure inlet. The system may also include means for removing some liquid from the slurry between said slurrying vessel and low pressure inlet, and returning removed liquid to the slurrying vessel.

The present invention also includes a system for feeding comminuted cellulosic fibrous material to a treatment vessel having an inlet, comprising or consisting of: a first vessel containing a slurry of comminuted cellulosic fibrous material having a first liquid-to-material volume ratio; a high-pressure transfer device having an low-pressure inlet, a low-pressure outlet, a high-pressure inlet and a high-pressure outlet; means for pressuring and transferring the slurry from the first vessel to the low-pressure inlet of the high-pressure transfer device; means for diluting the slurry and transferring the slurry from the high-pressure outlet to the treatment vessel at a second liquid-to- material ratio, greater than the first ratio; and means for removing at least some of the liquid from the slurry located between the high-pressure outlet of the high-pressure transfer device and the treatment vessel inlet to provide a slurry having a third liquid-to-material ratio less than the second ratio to the inlet of the treatment vessel.

The first vessel is preferably a Chip Chute or Chip Tube provided by Ahlstrom Machinery. The high-pressure transfer device is preferably a High-pressure Feeder as sold by Ahlstrom Machinery. The means for pressurizing and transferring said slurry to the high-pressure transfer device may be a chip pump for pumping the slurry into the high-pressure transfer device or a pump (for example, a pump known as a Chip Chute Circulation Pump) for drawing the slurry into the high-pressure transfer device, or any other suitable conventional pressurizing device. The means for diluting the slurry and transferring the slurry from the high-pressure outlet of the high-pressure transfer device is preferably a high-pressure pump that provides pressurized liquid to the high-pressure inlet of the high-pressure transfer device. The means for removing liquid from the slurry is preferably a cylindrical device having a concentric cylindrical screen through which the slurry passes and from which liquid can be removed. One such device is an In-line Drainer sold by Ahlstrom Machinery but the means may comprise any other suitable conventional device which can readily separate liquid from a moving slurry. The preferred liquid-to-material ratios and pressures are as described above.

The above methods and apparatuses in which liquid is removed prior to introducing a slurry to the high pressure transfer device or liquid is removed after the slurry is discharged from the high-pressure transfer device can be used alone or in tandem. In either case, the flow of liquid from the two liquid removal devices is preferably controlled, for example, by appropriate valves, and in one embodiment the flows can be combined. The temperature of the individual liquids or of the combined liquid is preferably monitored and limited to a temperature that will prevent flashing of the liquid in the feed system. This is preferably effected by controlling the amount of liquid removed from the respective liquor separators, for example, by appropriate valves. The temperature of the liquids may also be controlled by passing one or more of the liquids through a cooling heat exchanger. This cooling heat exchanger may be used to heat other fluids, such as dilution liquids or cooking liquor, including kraft white liquor.

The present invention also includes a system for feeding a slurry of comminuted cellulosic fibrous material to a treatment vessel, comprising or consisting of: a first vessel containing a slurry of material and liquid having a top and a bottom, with an inlet adjacent the top and an outlet adjacent the bottom; a high-pressure transfer device having a low pressure inlet, a low pressure outlet, a high-pressure inlet, and a high-pressure outlet, the high-pressure outlet operatively connected to the treatment vessel; a pump, operatively connected to the outlet of the first vessel, for pressuring and transferring the slurry to the low-pressure inlet of the high-pressure transfer device; and means for removing liquid from the slurry located between the pump and the treatment vessel. The means for removing liquid from the slurry is distinct from the high-pressure transfer device. The treatment vessel is preferably one or more continuous digesters, or one or more batch digesters, for producing cellulose pulp.

The means for removing the liquid from the slurry is preferably a cylindrical vessel having a perforated barrier or screen that allows liquid to pass but retains the fibrous material in the slurry. One preferred device is an In-line Drainer, as described and illustrated in FIG. 2 of U.S. Pat. No. 5,401,361, the disclosure of which is included by reference herein, but the means may comprise any other suitable conventional device which can readily separate liquid from a moving slurry. This device may be located immediately upstream or downstream of the high-pressure transfer device, or two such devices may be used: one upstream of the transfer device and one downstream.

In a preferred embodiment, the means for removing liquid from the slurry comprises a first means located near to or adjacent the inlet of the treatment vessel while the treatment vessel also includes a second means for removing liquid from the slurry. In this embodiment, the liquid removed from the first means and second means is combined and returned to the high-pressure transfer device. The first means is preferably an In-line Drainer and the second means is preferably a Top Separator, Inverted Top separator, or "stilling well" arrangement located in the inlet of the treatment vessel, but other conventional devices may alternatively or additionally be utilized. The first and second means for removing liquid also preferably include a means for regulating the flow of liquid removed, for example, using conventional control valves. Also, the invention preferably includes means for measuring the temperature of the combined liquids, and means for regulating the flow of liquid from the first and the second means for removing liquid to maintain a specified maximum temperature of the combined liquids.

The present invention preferably also includes a pretreatment vessel, for example, a steaming vessel, having an inlet and an outlet which communicates with the inlet of the first vessel. The pretreatment vessel is preferably a DIAMONDBACK® steaming vessel as sold by Ahlstrom Machinery and described in U.S. Pat. Nos. 5,500,083; 5,617,975; 5,628,873; and 4,958,741, or a CHISELBACK™ vessel as described in co-pending application Ser. No. 09/055,408 filed on Apr. 6, 1998, though other more conventional screw-conveyor-type steaming vessels, or other conventional constructions, may be used. The present invention also preferably includes a metering device positioned between the pretreatment vessel and the first vessel. The metering device may be a star-type metering device, such as a Chip Meter as sold by Ahlstrom Machinery, or a screw-type metering device. In a preferred embodiment of the invention, the first vessel is a Chip Tube or Chip Chute as also sold by Ahlstrom Machinery.

As discussed above, one liquid separating device that is particularly useful in the practice of the present invention is a cylindrical device having a cylindrical screen through which the slurry passes and from which liquid is removed, for example, an In-line Drainer, as sold by Ahlstrom Machinery Inc. of Glens Falls, N.Y. An In-line Drainer is typically used to isolate a stream of liquid from a stream of liquid that typically contains at least some wood chips or fine wood particles, for example, what are known as "fines" and "pins". However, an In-line Drainer can also be used in the practice of the present invention where a liquid is preferably removed from a slurry containing a larger amount of cellulose material, in particular wood chips.

In the conventional use of an In-line drainer, the drainer is positioned in a feed system of a continuous digester, for example, in the outlet of a Sand Separator [as shown by item 37 in FIG. 2 herein]. The liquid passed to the drainer from the Sand Separator can typically contain at least some wood particles or other material. The In-Line Drainer is typically used to remove excess liquid from the low pressure liquor circulation associated with the feed system, that is, the Chip Chute Circulation, to control the volume of liquid, for example, in the Chip Chute or Chip Tube. Conventional drainers include cylindrical screen baskets fashioned from steel bars oriented parallel to the direction of flow so that the liquid passes through vertical slots or apertures while retaining wood particles within the circulation. However, due to the low concentration of chips, pins, and fines in the liquid passing through the drainer, the flow of liquid through the basket is such that the chips, pins, and fines are oriented in the direction of flow which is also parallel to the slots in the basket. As a result, without taking appropriate measures, the chips, pins, and fines can align with and undesirably pass through the vertical slots or become lodged in the vertical slots of the drainer.

In the drainer of the conventional art, for example, as shown in FIG. 5 herein, the potential for chips, pins, and fines to align with and pass through the vertical slots of the drainer basket is minimized by introducing a horizontal velocity component to the liquid flow as it is passes through the drainer. This is typically achieved by introducing a helical baffle, or so-called "flight", to the inlet of the drainer in order to impart a helical flow to the liquid as it is introduced to the drainer and passes through the drainer basket. Due to this helical flow, any chips, pins, or fines that may be present are oriented in the direction of the helical flow and thus oriented obliquely to the elongation of the slots of the vertical bars. Thus, in the conventional art, the helical flight in the inlet reduces the tendency for chips, pins, and fines to pass through the drainer basket or to be lodged in the slots of the drainer basket and cause pluggage of the drainer.

Though this conventional In-line Drainer has proven to be very effective in most applications, the flight positioned in the inlet of the conventional drainer has, in some applications, been associated with an undesirable pressure drop across the drainer. That is, the helical baffle introduces an impediment to flow which causes a decrease in hydraulic pressure from the pressure of the liquid introduced to the drainer to the pressure of the liquid leaving the drainer. This pressure drop impedes the flow of liquid through the drainer and also reduces the pressure of the liquid downstream of the drainer, which can interfere with the proper operation of downstream equipment, for example, the Level Tank or Make-up Liquor Pump. This flow impediment can also reduce the velocity of the flow and thus increase the likelihood for chips, etc. to pass through or become lodged in the screen.

According to another aspect of the present invention, the helical baffle present in the inlet of prior art In-line Drainers and the source of pressure drop associated with this baffle are eliminated yet the Drainer still functions properly. To account for the loss of the baffle's function, according to the present invention, the slots or apertures of the screen basket are aligned obliquely to the direction of elongation of the drainer, and thus obliquely to the direction of flow of the liquid through the drainer. The angle of the slots relative to the direction of elongation of the screen can range from between about 5 to 90 degrees. For example, in one embodiment the slots are oriented substantially perpendicular to the direction of elongation and direction of flow. In the preferred embodiment, the slots are oriented at an angle of about 10° to 80°, preferably about 30° to 60°, most preferably about 40° to 50°.

One embodiment of the present invention consists or comprises a liquid separating device having a cylindrical housing elongated in a direction of elongation having an inlet at a first end of the housing, an outlet at a second end, opposite, the first end, and an inside surface; a cylindrical screen assembly centrally mounted in the housing having a plurality of elongated apertures having an angle of orientation and an outside surface; an annular cavity formed by the outside surface of the screen and the inside surface of the housing; and an outlet for separated liquid located in the housing and communicating with the annular cavity; wherein the angle of orientation of the screen assembly apertures is oblique to the direction of elongation of the housing. The angle of orientation is preferably at least 5° to the direction of elongation of the housing or screen basket, but is typically between about 10° to 80°, preferably about 30° to 60°, most preferably 40° to 50° to the direction of the elongation of the housing or screen basket. For example, the orientation of the slots relative to the elongation of the housing is about 45°.

The drainer slots may be continuous slots or they may be interrupted by unperforated "land" areas. These land areas may be uniformly located throughout the screen basket so that a uniform pattern of slots and land areas is provided or the slots and land areas may be distributed non-uniformly. The orientation of the slots may also vary, for example, the angle of orientation of the slots at one elevation in the direction of elongation of the screen basket may be different from the orientation of the slots at second or an adjacent elevation. The orientation of slots at one elevation in the direction of elongation of the screen basket may also vary, for example, producing a "herring bone"-type pattern of slots. The screen slot configuration of this device may be similar or identical to the screen designs illustrated and described in U.S. Pat. Nos. 6,039,841 or 6,165,323, the disclosures of which are incorporated by reference herein.

A The slots may be fabricated from parallel-bar-type or parallel-wire-type construction or they may be machined from plate, for example, by water-jet cutting, laser cutting, EDM machining, drilling, milling, or any other conventional method of producing apertures in plate. The housing or screen basket material is typically metallic, for example, steel, steel-based alloy, stainless steel, aluminum, titanium or any other commercially available metal, but may also be manufactured from a high-performance plastic or composite material.

The drainer according to the present invention may be used in a conventional feed system, as shown by item 37 in FIG. 2 of this application, or for treating slurries according to the method and apparatuses of the present invention, for example, as shown as items 153 and 154 of FIG. 3 or item 254 of FIG. 4.

The invention can be used in a feed system with or without a high pressure feeder (HPF). A feed system utilizing one or more slurry pumps that can be used according to the invention is shown in U.S. Pat. Nos. 5,735,075, 6,106,668 and 6,325,890, the disclosures of all of which are hereby incorporated by reference herein.

That is, according to his aspect of the invention there is provided a system for feeding comminuted cellulosic fibrous material to a treatment vessel, comprising: a first vessel containing a slurry of comminuted cellulosic fibrous material having a first liquid-to material volume ratio; means for pressuring and transferring the slurry from the first vessel to the treatment vessel; and means located between the first vessel and the treatment vessel for removing at least some of the liquid from the slurry. The means for removing at least some of the liquid from the slurry preferably provides a slurry having a second liquid-to-material ratio less than said first ratio, and may comprise any known removal device, as described above. The means for pressuring and transferring the slurry may comprise one or more slurry pumps, or at least one conventional high pressure transfer device (e.g. a HPF) having a low-pressure inlet, a low-pressure outlet, high pressure inlets and outlets, and one or more through-extending pockets.

The invention may also comprise a method of feeding a slurry of comminuted cellulosic fibrous material to a treatment vessel comprising: a) slurrying the material with a slurrying liquid to produce a slurry of material and liquid having a first liquid-to-material volume ratio; b) pressurizing the slurry to a first pressure; c) transferring the slurry to the treatment vessel; d) introducing the pressurized slurry to the treatment vessel; and e) removing at least some of the liquid from the slurry between b) and d). In the method e) may be practiced so that the slurry introduced to the treatment vessel in d) has a second liquid-to-material ratio lower than the first ratio. Also the method may further comprise, between b) and c), f) transferring the slurry to a high-pressure transfer device; g) introducing the slurry to the high-pressure transfer device; h) in the high-pressure transfer device, pressurizing the slurry to a second pressure, higher than the first pressure, using a pressurized liquid, to produce a slurry of liquid having a second liquid-to-material volume ratio, higher than the first ratio; and i) discharging the slurry having the second liquid-to-material volume ratio from the high-pressure transfer device. Typically the method further comprises between b) and c), pressurizing the slurry to a second pressure, higher than the first pressure.

These and other embodiments of this invention will become more apparent upon review of the following drawings and the attached claims.

DETAILED DESCRIPTION OF THE DRAWINGS

Figure 1:
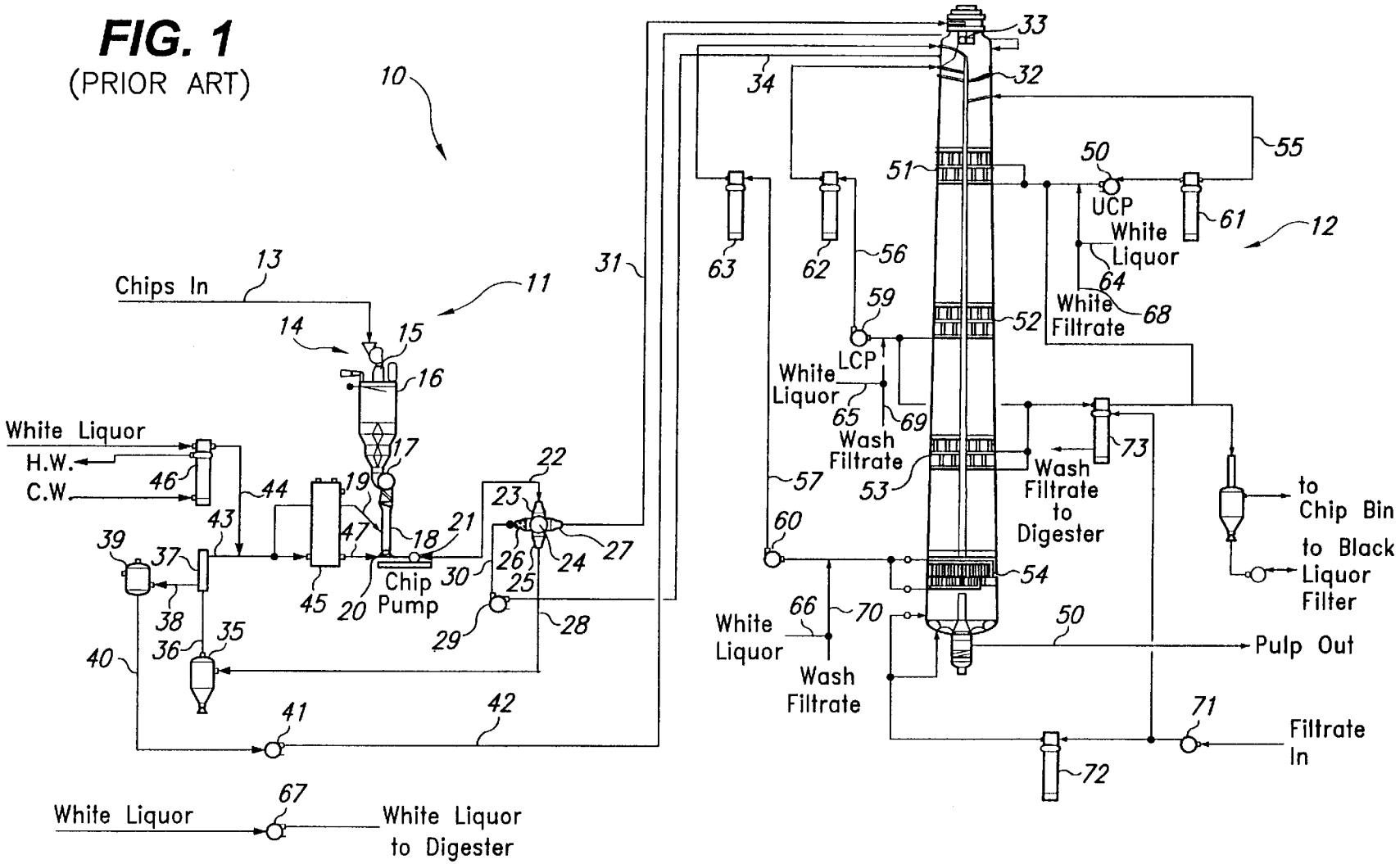
FIG. 1 (PRIOR ART)
FIG. 1 is a schematic illustration of a continuous digester system employing a prior art feed system over which the present invention is an improvement.
Figure 2:
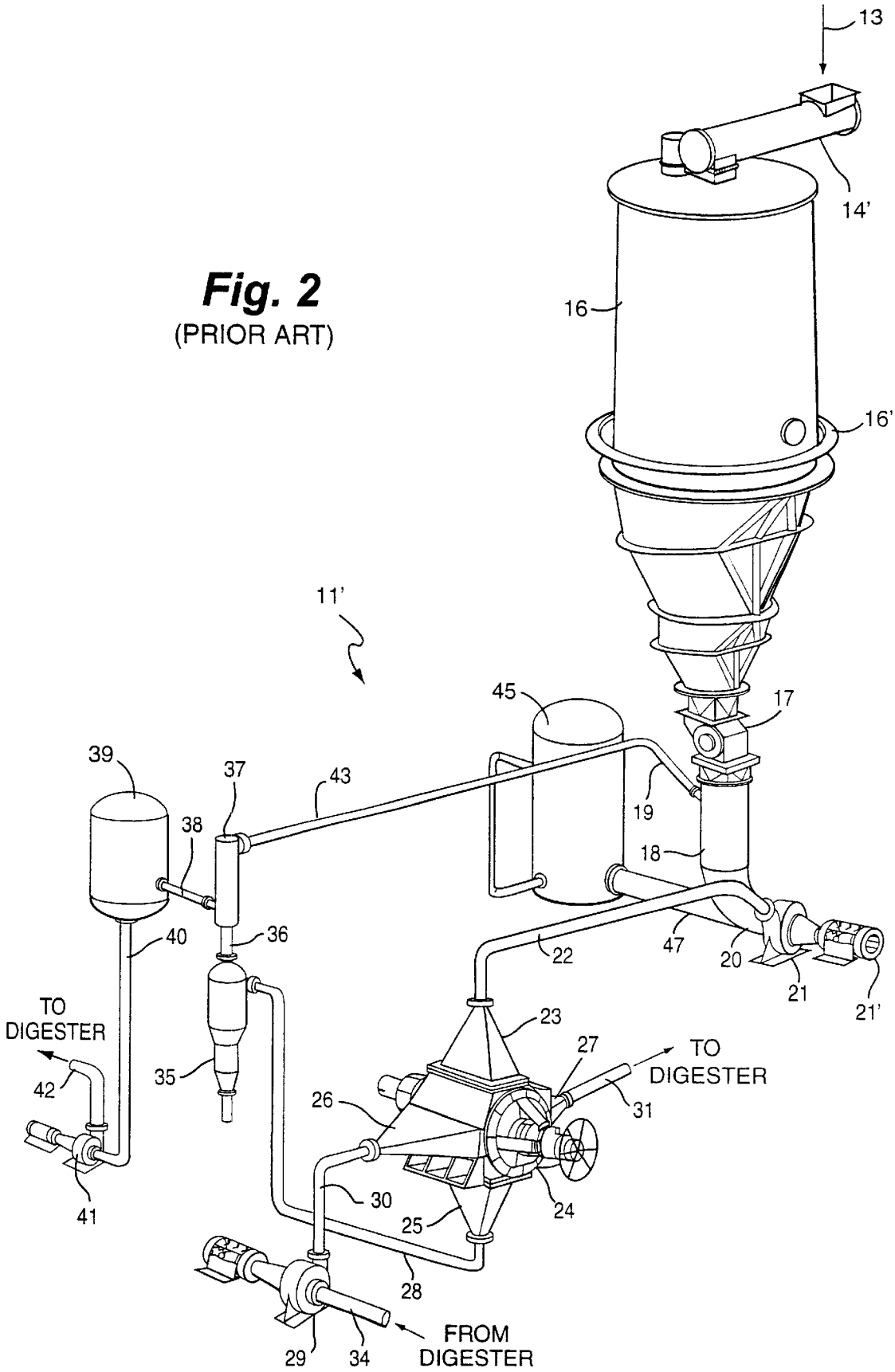
Fig. 2 (PRIOR ART)
FIG. 2 is a detailed view of the prior art feed system used in the digester system of FIG. 1.

FIGS. 1 and 2 illustrate typical prior art systems for handling the feeding and treatment of comminuted cellulosic fibrous material to produce cellulose pulp. FIG. 1 illustrates a cellulose treatment system 10 having a feed system 11 and a digester system 12. FIG. 2 illustrates a detailed view of a similar feed system 11' for introducing, steaming, slurrying and pressurizing comminuted cellulosic fibrous material, for example, hardwood or softwood chips, and feeding the slurry to a continuous digester system 12. These systems are disclosed in U.S. Pat. Nos. 5,476,572; 5,622,598; 5,635,025; 5,766,418; and 5,968,314 and are marketed under the trademark LO-LEVEL® by Ahlstrom Machinery.

Though comminuted cellulosic fibrous material may take many forms, including sawdust; grasses, such as straw or kenaf; agricultural waste, such as bagasse; recycled paper; or sawdust, for the sake of simplicity, the term "chips" will be used when referring to comminuted cellulosic fibrous material; but any and all of the listed materials, and others not listed, may be processed by the present invention. Also, though a continuous digester in shown in FIG. 1, it is understood that the present invention as also applicable to feeding several continuous digesters or one or more discontinuous or batch digesters.

As shown in FIGS. 1 and 2, chips 13 are introduced to the system, for example, via a conveyor (not shown) from a chip storage facility, for example, a woodyard, via an isolation and metering device 14,14'. For example, FIG. 1 illustrates a star-type Air-lock Feeder as sold by Ahlstrom Machinery Inc. of Glens Falls, N.Y. FIG. 2 illustrates a screw-type isolation device 14' described in U.S. Pat. No. 5,766,418 and having a similar function to device 14 of FIG. 1. The device 14,14', driven by an electric motor (not shown), introduces the chips to chip retention and streaming vessel 16 by means of a counter-weighted gate assembly 15. Though various types of vessels are known in the art, vessel 16 is preferably a DIAMONDBACK® Steaming vessel as marketed by Ahlstrom Machinery and described in U.S. Pat. Nos. 5,500,083; 5,617,975; 5,628,873; and 4,958,741, or a CHISELBACK™ vessel as described in co-pending application Ser. No. 09/055,408 filed on Apr. 6, 1998. This vessel typically includes a gamma-radiation level-detection system, a regulated vent for discharging gases which accumulate in the vessel and one or more steam introduction conduits (16' in FIG. 2), as is conventional. The pressure in the vessel 16 may be slightly below atmospheric pressure or slightly above atmospheric pressure, that is, the pressure in vessel 16 may vary from about −1 to 2 bar gage (that is, about 0 to 3 bar absolute).

During treatment with steam in vessel 16, the air that is typically present in the chips is displaced by steam and the heating of the chips is initiated. The removal of air from the cavities within the chips permits the more efficient diffusion of cooking chemical into the chip and minimizes the buoyant forces on the chip during subsequent processing.

The steamed material is discharged from the bottom of the vessel 16 to a metering device 17, for example, a star-type metering device or Chip Meter as sold by Ahlstrom Machinery, though any type of meeting device may be used. The metering device 17 is typically driven by an electric motor (not shown) and the speed of rotation of the metering device is typically controlled by operator input to define a set rate of introducing chips to the system. The chips discharged by the metering device 17 are introduced to a vertical conduit or pipe 18, for example, a Chip Tube sold by Ahlstrom Machinery. Cooking chemical and other liquids are typically first introduced to the chips in conduit 18 by means of one or more conduits 19 such that a level of liquid is established in conduit 18 and a slurry of chips and liquid is present in the bottom of conduit 18. This level of liquid is typically monitored and controlled by a level detection device, for example, a gamma-radiation level detection device or a "d-p" cell. The metering device 17 typically does not act as a pressure isolation device, though it may, and the pressure in conduit 18 typically varies from 0 to 2 bar gage (or 1 to 3 bar absolute).

Conduit 18 discharges the slurry of chips and liquid by means of a radiused section 20 to the inlet of slurry pump 21. Though any slurry pump can be used, pump 21 is preferably a Hidrostal® screw centrifugal pump sold by Wemco Pump of Salt Lake City, Utah or a pump provided by Lawrence Pumps Inc. of Lawrence, Mass. Slurry pump 21, driven by electric motor 21' (see FIG. 2), pressurizes and transfers the slurry in conduit 18 via conduit 22 to the low pressure inlet 23 of a high pressure transfer device 24. This high pressure transfer device is preferably a High-pressure Feeder as sold by Ahlstrom Machinery. High-pressure Feeder 24 includes a pocketed rotor mounted in a housing typically having a low-pressure inlet 23, a low-pressure outlet 25, a high-pressure inlet 26 and a high-pressure outlet 27. The low-pressure outlet 25 typically includes a screen plate (not shown) which minimizes the passage of chips out of low-pressure outlet 25 while allowing the liquid in the slurry to pass out outlet 25 to conduit 28, though as disclosed in pending application Ser. No. 60/138,280 filed on Jun. 9, 1999, the screen in the low-pressure outlet of feeder 24 may be omitted. The chips which are retained in the feeder by the screen are slurried with high-pressure liquid provided by pump 29, preferably a Top Circulation Pump (TCP) provided by Ahlstrom Machinery, to inlet 26 via conduit 30. The slurry is discharged out of high-pressure outlet 27 into conduit 31 and to the digester 32 of digester system 12 at a pressure of between about 5 and 15 bar gage, typically between about 7 to 12 bar gage.

Digester 32 (see FIG. 1) may be a single or multiple-vessel digester and may be a hydraulic or steam-phase digester. Digester 32 may also consist or comprise one or more batch digesters. The cellulose material with added cooking chemical is treated under temperature and pressure in digester 32 and essentially fully-treated chemical cellulose pulp is discharged into conduit 50 at the bottom of the digester. Digester 32 typically includes a plurality of screen assemblies 51, 52, 53, and 54; liquor circulations 55, 56, and 57 having pumps 58, 59, and 60 and heat exchangers 61, 62, and 63; cooking liquor introduction conduits 64, 65, and 66, supplied by pump 67, as is conventional, in order to treat the cellulose material. Though many types of processes may be performed in digester 32, one preferred process is the process described in U.S. Pat. Nos. 5,489,363; 5,536,366; 5,547,012; 5,575,890; 5,620,562; 5,662,775; 5,824,188; 5,849,150; and 5,849,151 and marketed by Ahlstrom Machinery under the trademark LO-SOLIDS®. According to this preferred process, one or more dilution liquid (for example, wash filtrate) introduction conduits 68, 69, and 70 are provided which are supplied by filtrate pump 71, also known as a Cold Blow Pump (CBP). The liquid pressurized by pump 71 may be heated or cooled as desired by heat exchangers 72 and 73. The process performed in digester 32 may also be one of the processes disclosed in U.S. Pat. Nos. 5,635,026 or 5,779,856 and marketed under the name EAPC™ cooking by Ahlstrom Machinery.

As shown in FIG. 1, excess liquor in the slurry in conduit 31 at the top of the digester 32 is separated from the slurry by a liquor separator 33 and returned to the feed system 11 by means of conduit 34 (again, also shown in FIG. 2). The liquid in conduit 34 is pressurized by pump 29, driven by electric motor 29' (FIG. 2), and provides the pressurized slurrying liquid introduced to the high-pressure inlet 26 of feeder 24 via conduit 30. Feeder 24 is typically driven by an electric motor (not shown), the speed of which is monitored and controlled.

As shown in both FIGS. 1 and 2, the liquid discharged from the low-pressure outlet 25 of high-pressure feeding device 24 passes via conduit 28 to a cyclone-type separator 35 which isolates undesirable material and debris, such as sand, stones, etc., from the liquid in conduit 28. Separator 35 is preferably a Sand Separator as sold by Ahlstrom Machinery. Liquid having little or no undesirable material or debris is discharged from separator 35 and is passed through a liquor separating device 37 via conduit 36. At least some liquid is removed from the liquid separator 35, which is preferably an Inline Drainer as sold by Ahlstrom Machinery, via conduit 38 and sent to vessel 39. Vessel 39 is preferably a Level Tank as sold by Ahlstrom Machinery. Liquid is discharged from vessel 39 to conduit 40 and pump 41 and is supplied to digester 32 (see FIG. 1) as liquor make-up as needed via conduit 42. Pump 41 is preferably a Make-Up Liquor Pump (MLP) as sold by Ahlstrom Machinery. As also disclosed in pending application Ser. No. 60/138,280 the Sand Separator 35, Level Tank 36, and In-line Drainer 37 can be omitted without interfering with the ultimate function of the feed system 11.

The liquid discharged from separator 37 into conduit 43 may be supplemented with cooking chemical, for example, kraft white, green, orange (that is, liquid containing polysulfide additives) or black liquor, introduced via conduit 44 (see FIG. 1) prior to being introduced to tank 45. Tank 45 is preferably a Liquor Surge Tank as sold by Ahlstrom Machinery and described in U.S. Pat. No. 5,622,598. The cooking chemical introduced via conduit 44 may be heated or, preferably, cooled as needed by heat exchanger 46 (see FIG. 1). Some of the liquid in conduit 43 may bypass tank 45 and be introduced via conduit 19 to conduit 18 as described above. Tank 45 communicates with conduit 18 and the inlet of pump 21 via conduits 47 and 20. As disclosed in pending application Ser. No. 60/124,890 filed on Mar. 18, 1999, tank 45 may comprise or consist of an integral vessel concentric with conduit 18.

According to the prior art system shown in FIGS. 1 and 2, the amount of liquid in the slurry transferred in conduit 22 by pump 21 is governed by the capacity of the pump 21. That is, typically screw-type-impeller slurry pumps, such as the Wemco Hidrostal® pump, are limited to pumping slurries having a minimum liquid content, that is, a minimum liquid-to-solid, or, in this case, a limited liquid-to-wood chip, ratio. Thus, in prior art systems, the amount of solid material that can be subsequently transferred by the high-pressure transfer device 24 is governed and limited by the solid transfer capacity of the pump 21. The present invention overcomes this limitation of the prior art.

Figure 3:
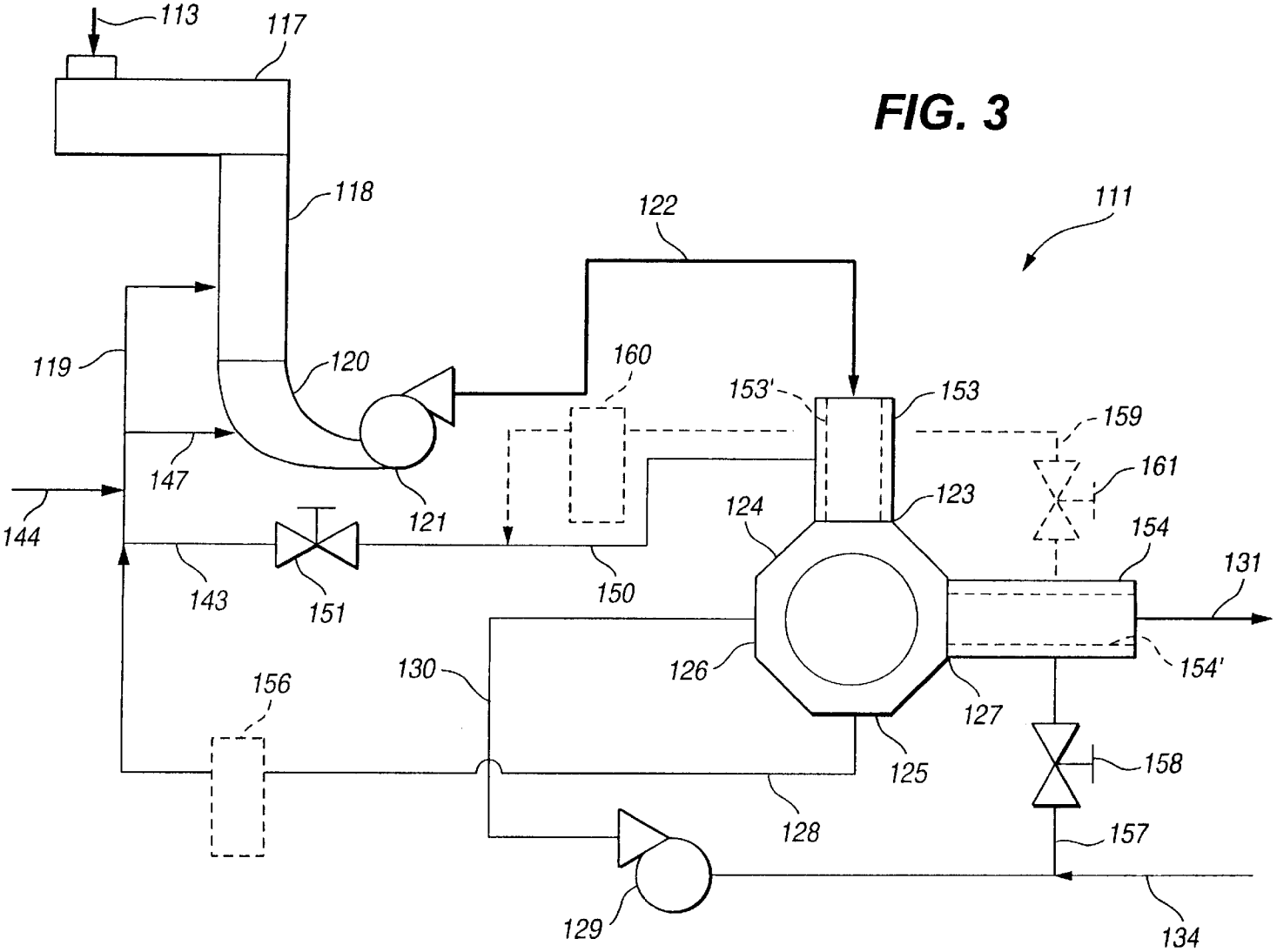
FIG. 3 is a schematic illustration of one embodiment of the present invention.

FIG. 3 illustrates one embodiment of the present invention. FIG. 3 illustrates a feed system 111 including many of the components found in feed system 11 of FIG. 1 and feed system 11' of FIG. 2. Similar components in FIG. 3 to those shown in FIGS. 1 and 2 are identified by the same reference numerals shown in FIGS. 1 and 2 but preceded by the a "1".

Steamed chips 113 are introduced to horizontal metering-screw conveyor 117 in FIG. 3. Conveyor 117 performs a similar function as metering device 17 in FIGS. 1 and 2. Chips, or other comminuted cellulosic fibrous material, 113 are typically steamed in a steaming vessel prior to being introduced to conveyor 117, for example, the chips are steamed in a DIAMONDBACK® steaming vessel such as vessel 16 shown in FIG. 2. The chips 113 are discharged from metering screw 117 into a vertical conduit or vessel 118, which is preferably a Chip Tube or Chip Chute. Conduit or vessel 118 may include a radiused tramp material separation device as disclosed in copending application Ser. No. 08/905,324 filed on Aug. 4, 1997 [Attorney. Ref. 10-1213], the disclosure of which is included by reference herein. In a preferred embodiment, the Chip Tube includes a radiused discharge 120 which feeds a slurry pump 121. The slurry pump 121 is preferably a Hidrostal® pump or a Lawrence Pump. Slurrying liquid is introduced to conduits 118 and 120 via conduits 119 and 147. The liquid introduced via conduits 119 and 147 typically includes some form of chip treatment liquid, for example, kraft white, green, or black liquor, weak black liquor, soda liquor, or liquor including some form of strength or yield enhancing, or metal sequesting additive, such as polysulfide, anthraquinone, chelating agents (such as EDTA and DPTA and their equivalents), surfactants, penetrants, or their equivalents or derivatives. The treatment liquid is introduced via conduit 144. Pump 121 pressurizes and transfers the slurry via conduit 122 to a high-pressure transfer device 124, for example, a High Pressure Feeder sold by Ahlstrom Machinery.

Slurry pumps, such as the Hidrostal pump, typically require that the slurry being pumped have a minimum content of liquid, that is, a minimum liquid-to-wood (L/W) volume ratio. For the Wemco Hidrostal slurry pump 121 shown, the L/W ratio of the slurry must be at least 2.75:1, preferably at least 3.0:1. That means that the slurry passing through conduit 122 and being introduced to feeder 124 also has approximately this same L/W ratio. In conventional systems, the pump 121 requirement limits the L/W ratio of the slurry introduced to and transferred by the feeder 124.

However, according to the present invention, the L/W ratio of the slurry introduced to the feeder 124 is not limited by the L/W ratio that can be transferred by the slurry pump 121. According to the present invention, some form of liquid removal device 153 is provided upstream of the feeder 124 which removes at least some of the liquid in the slurry in conduit 122 so that the slurry introduced to the feeder 124 has a lower L/W ratio, typically at least about 0.25 lower, preferably at least about 0.5 lower, than the slurry transferred by pump 121.

The liquid removal device, or dewatering device, 153 shown schematically in FIG. 3 may be an isolated device or it may be integral with the feeder 124. The device 153 typically includes a liquid permeable barrier or screen 153', for example, a perforated cylinder, which retains the material (chips) in the flow of slurry while removing at least some of the liquid from the slurry into conduit 150. The screen or barrier 153' may be made from perforated plate, for example, screen plate having circular or slotted holes, or may be made from parallel bar-type screen construction. Device 153 may include rotating, reciprocating, vibrating, or otherwise movable components which by their movement minimize or prevent the pluggage of the screen or barrier. The device 153 may also include some form of conventional back-flush mechanism (not shown) which periodically forces a flow of liquid in a direction opposite the direction that the liquid is typically removed to again minimize or prevent pluggage of the screen or barrier. One device that may be used for dewatering device 153 is an In-line Drainer as sold be Ahlstrom Machinery (this device is illustrated in FIG. 2 of U.S. Pat. No. 5,401,361, the disclosure of which is included by reference herein).

Conduit 150 transports the liquid removed from the slurry back to conduits 118 and 120 via conduits 143, 119, and 147 to provide the slurrying liquid to conduits 118,120. This flow of liquid is typically supplemented with treatment chemical, as described above, via conduit 144. The flow of liquid through conduit 150,143 is typically regulated by a (preferably solenoid operated) flow control valve 151. Conduit 143 may include a conventional Sand Separator (item 35 in FIG. 2), In-line Drainer (item 37 in FIG. 2), Level Tank (item 39 in FIG. 2), and Liquor Surge Tank (item 45 in FIG. 2), if desired.

The slurry having reduced liquid content is then introduced to the low-pressure inlet 123 of feeder 124. The operation and components of feeder 124 are described in U.S. Pat. Nos. 5,236,285 and 5,236,286, the disclosures of which are included by reference herein. The pocketed rotor (not shown) of the feeder 124 accepts the slurry having reduced liquid content and, through rotation, exposes the slurry to high-pressure liquid supplied to the high-pressure inlet 126 by high pressure pump 129 via conduit 130. This high-pressure flow flushes the chips from the rotor pocket and discharges them out of high pressure outlet 127 and into conduit 131. The slurry, now diluted with pressurized liquid introduced by pump 129, is then propelled to the top of a treatment vessel (item 32 shown in FIG. 1) via conduit 131. Conventionally, the slurry in conduit 131 typically has a L/W ratio greater than 6.0:1, possibly even greater than 8.0:1. Again, this treatment vessel may be one or more continuous digesters or one or more batch digesters. The continuous digester may be a hydraulic or vapor-phase digester having one or more vessels, for example, the digester may include an impregnation vessel.

As is conventional, excess liquid may be removed from the slurry upon introduction to the digester, such as by using a liquid separation device, for example, a Top Separator (item 33 in FIG. 1). This separated liquid is returned to feed system 111 via conduit 134 to supply at least some of the liquid provided by pump 129 to the high-pressure inlet 126 of feeder 124.

As the slurry is introduced to feeder 124 via conduit 122 at least some of the liquid in the slurry passes through the rotor pocket (again, not shown) and is discharged from the feeder 124 via low-pressure outlet 125. The outlet 125 may include a conventional screen element to prevent the passage of chips out of outlet 125 or no screen element may be present. As in conventional operation, the liquid moving through outlet 125, which is under pressure supplied by pump 121, is passed via conduit 128 to conduits 119 and 147 to provide the source of slurrying liquid in conduits 118 and 120. However, in the embodiment of the present invention shown in FIG. 3, the slurrying liquid is also provided to conduits 118,120 via conduits 119,147,150 and 143 from dewatering device 153. Since the liquid in line 128 may be hotter than 100° C. and the pressure in conduits 143,147, 118,119, or 120 may be lower than 1 atm, to prevent flash evaporation, the liquid in line 128 may be cooled by heat exchanger 156 prior to introducing the liquor to line 143.

Another advantage of the present invention is that by removing liquid from the slurry in conduit 122 via separator 153, prior to exposing this liquid to the hotter temperature liquid in feeder 124 (for example, the hot liquid returned from the treatment vessel via conduits 134 and 130), the temperature of the liquid returned to the typically unpressurized conduits 118 and 120 may be cooler. Therefore, the liquid in conduits 150,143,147 and 119 typically will not have to be cooled to prevent flash evaporation in these conduits or in conduits 118 and 120.

In another embodiment of the invention, a liquor separator 154 may also be introduced adjacent to the high-pressure outlet 127 of feeder 124. This separator 154 typically is similar to separator 153 described above and typically includes a barrier or screen 154' and, again, may be integral with the feeder 124 or separate from feeder 124. The separator 154 may be used in place of separator 153 or in conjunction with separator 153 to remove additional liquid from the slurry prior to passing the slurry via conduit 131 to the treatment vessel. The liquid removed using the separator 154, since it is pressurized and typically hotter than 100° C., is preferably passed via conduit 157 to conduit 134, which is also typically pressurized and hotter. The flow of liquid out of separator 154 and through conduit 157 is typically regulated by control valve 158, which is desirably automatically operated.

The liquid removed by means of separator 154 may also be returned to conduits 118 and 120 directly or via conduit 150 via conduit 159, shown in phantom. Since the liquid in conduit 159 may be hotter than 100° C., the liquid in conduit 159 will typically require some form of cooling prior to introducing it to conduit 150, for example, by passing it through heat exchanger 160. The flow of liquid through conduit 159 is typically regulated by valve 161.

In one mode of operation, the liquid removed from the slurry by separators 153 or 154 is of sufficient volume so that little or no excess liquor is introduced to the treatment vessel via conduit 131, so that in turn little or no liquid need be returned to the feed system via conduit 134, and conduit 134 may be eliminated. In such a case, the liquor separation device (item 33 in FIG. 1) is unnecessary and this device may be eliminated along with its associated cost and maintenance. Furthermore, by eliminating this return of liquid to the feed system from the treatment vessel, little or no heat that is typically returned with this liquid is introduced to the feed system. As a result, the impact of this heat upon the operation of the feed system, for example, undesirable liquid flashing, and upon the treatment of the material is reduced or substantially eliminated. For example, by employing this mode of operation, the cooler impregnation processes disclosed in U.S. Pat. Nos. 5,736,006 and 5,958,181 are more readily implemented.

Furthermore, should sluicing liquid be desired and the top separator (33 in FIG. 1) and the return line 134 from the top separator have been eliminated, sluicing liquor may also be obtained from one or more of the liquor circulations associated with digester 32 (see FIG. 1) which are closer in proximity than separator 33. In conventional pulp mill installations, pump 29 is physically located in an area adjacent to the pumps associated with the liquor circulations of digester 32, for example, pumps 50, 59, or 60 in FIG. 1. By using the liquors in these circulations, for example, the liquor extracted from the upper cooking circulation screens 51 and pressurized by pump 50, a more accessible source of sluicing liquor is obtained. For example, only a short pipe run need be required from the piping associated with pump 50 to the inlet of pump 29, instead of the long pipe run from the Top Separator 33 (in FIG. 1) at the top of the digester to pump 29 adjacent the feeder 24. In addition, the active cooking chemical, that is, the alkali, present in the circulations associated with the digester may offset the alkali typically needed in the feed system. The sluicing liquors obtained from these cooking circulations may also contain at least some sulfide which, as is known in the art, is beneficial to have in the treatment liquors used early in the cooking process, for example, in the sluicing liquor in conduit 34, 134.

Figure 4:
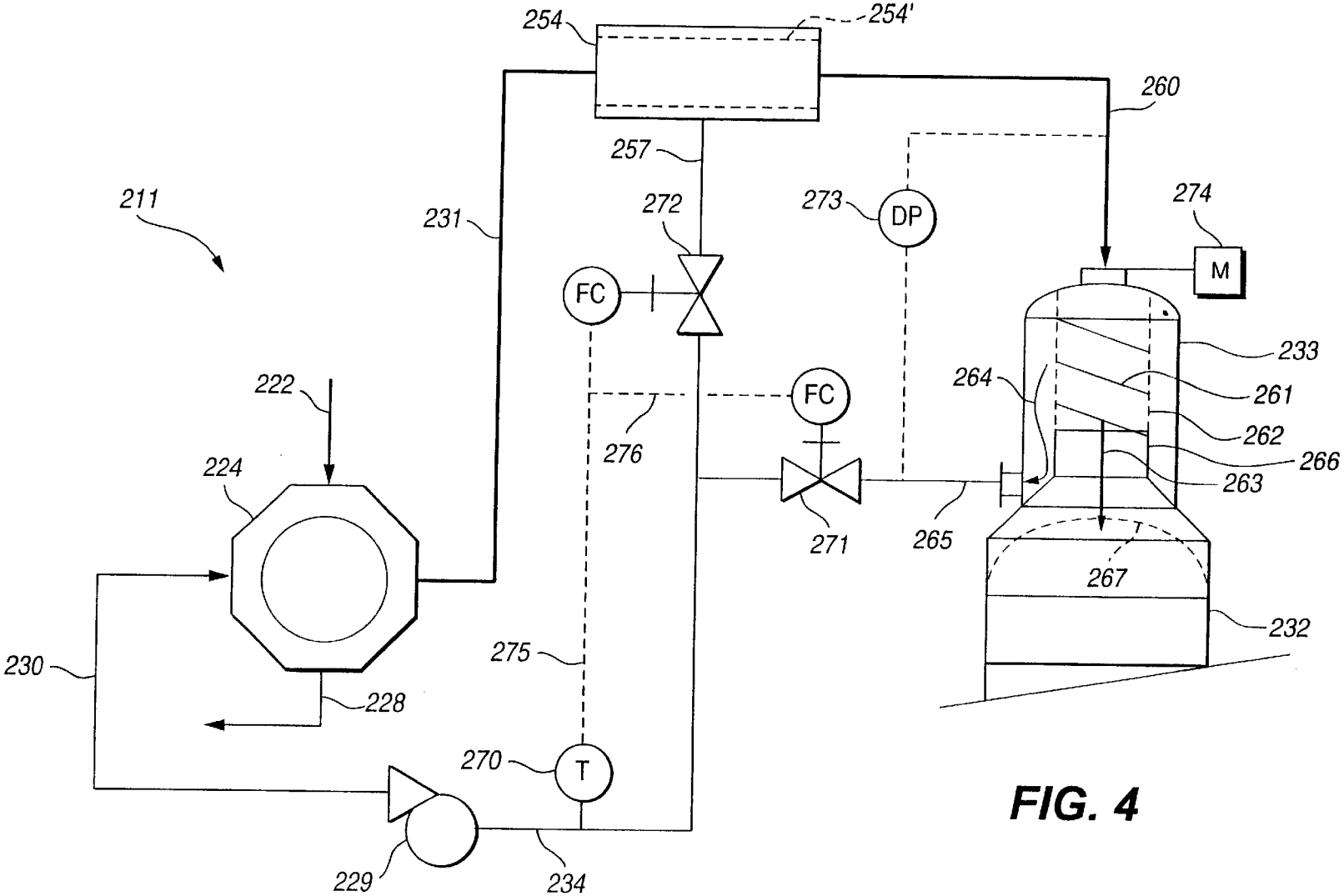
FIG. 4 is a schematic illustration of another embodiment of the present invention.

Another embodiment of the present invention is shown in FIG. 4. FIG. 4 partially illustrates a feed system 211 similar to feed systems 11,11', and 111 described above, which feeds a continuous digester 232, similar to digester 32 in FIG. 1. Components in FIG. 4 comparable to those in FIGS. 1–3 are shown by the same two digit reference numeral but preceded by a "2".

In feed system 211, a slurry of comminuted cellulosic fibrous material 222 is introduced to a high-pressure transfer device 224, similar to devices 24 and 124 above. This slurry 222 may be pressurized by a slurry pump, such as pumps 21 and 121 in FIGS. 1, 2, and 3, or may simply be provided by a conventional Chip Chute from a horizontal screw-type steaming vessel. The feeder 224 pressurizes and transfers the slurry to digester 232 via conduit 231. Though not shown in FIG. 4, liquid removal devices 153 and 154 may also be present adjacent the feeder 224 as shown in FIG. 3.

The inlet of the digester 232 includes a conventional liquor removal device 233, a Top Separator, such as item 33 in FIG. 1, having a screw conveyor 261, driven by electric motor 274, and a perforated cylindrical screen 262. The conveyor transfers the chips to the vessel in the direction of arrow 263 while removing liquid from the slurry as shown by arrow 264 and returning the liquid via conduits 265 and 234, the TC line, to pump 229 and to feeder 224 via conduit 230, as is conventional. The lower section of the separator housing 266 is preferably non-permeable so that little or no heated liquor can migrate from the exothermic reactions that are occurring in the chip column 267 in the vessel 232.

According to this embodiment of the invention, a liquor removal device 254 is located in conduit 231. This liquid removal device is preferably similar to devices 153 and 154 discussed above, and is preferably an In-line Drainer-type device as also discussed above. According to this invention, at least some liquid is removed from the slurry via device 254 via conduit 257, such that less liquid is introduced to the vessel 232 via conduit 260. As a result, less liquid need be removed from the slurry by separator device 233 and less heat is withdrawn from the vessel and returned to the feed system where the heat can cause operational problems. In addition, by reducing the temperature of the liquid returned to the feed system, cooler, more beneficial treatments of the cellulose can be performed in the feed system, for example, those methods disclosed in U.S. Pat. Nos. 5,736,006 and 5,958,181.

As shown in FIG. 4, the temperature of the liquid in line 234 is preferably monitored by temperature sensor 270. The temperature measured by sensor 270 can be used to regulate the flow of liquid from liquid separators 254 and 233, for example, control signals 275 and 276 and automatic flow control valves 271 and 272. Should the temperature of the liquid in line 234 exceed a specified value, for example, 100° C., the flow of hotter liquid through valve 271 can be reduced and the flow of cooler liquid through valve 272 can be increased. Also, the pressure drop across the inlet of the vessel, from conduit 260 to the outlet of the liquid separator at conduit 265, can be monitored by pressure difference sensor 273. This pressure difference can be limited to a specified value by controlling the speed of the screw of separator 233. The speed of this screw can be varied by varying the speed of the motor 274 driving the screw.

The invention particularly contemplates all specific narrow ranges within a broad range. For example a L/W ratio of between about 4.0:1 and 10:0:1 means 8.5:1 to 10.0:1, 4.5:1 to 6.5:1, 5.0:1 to 9.0:1, and all other narrower ranges within that broad range.

Figure 5:
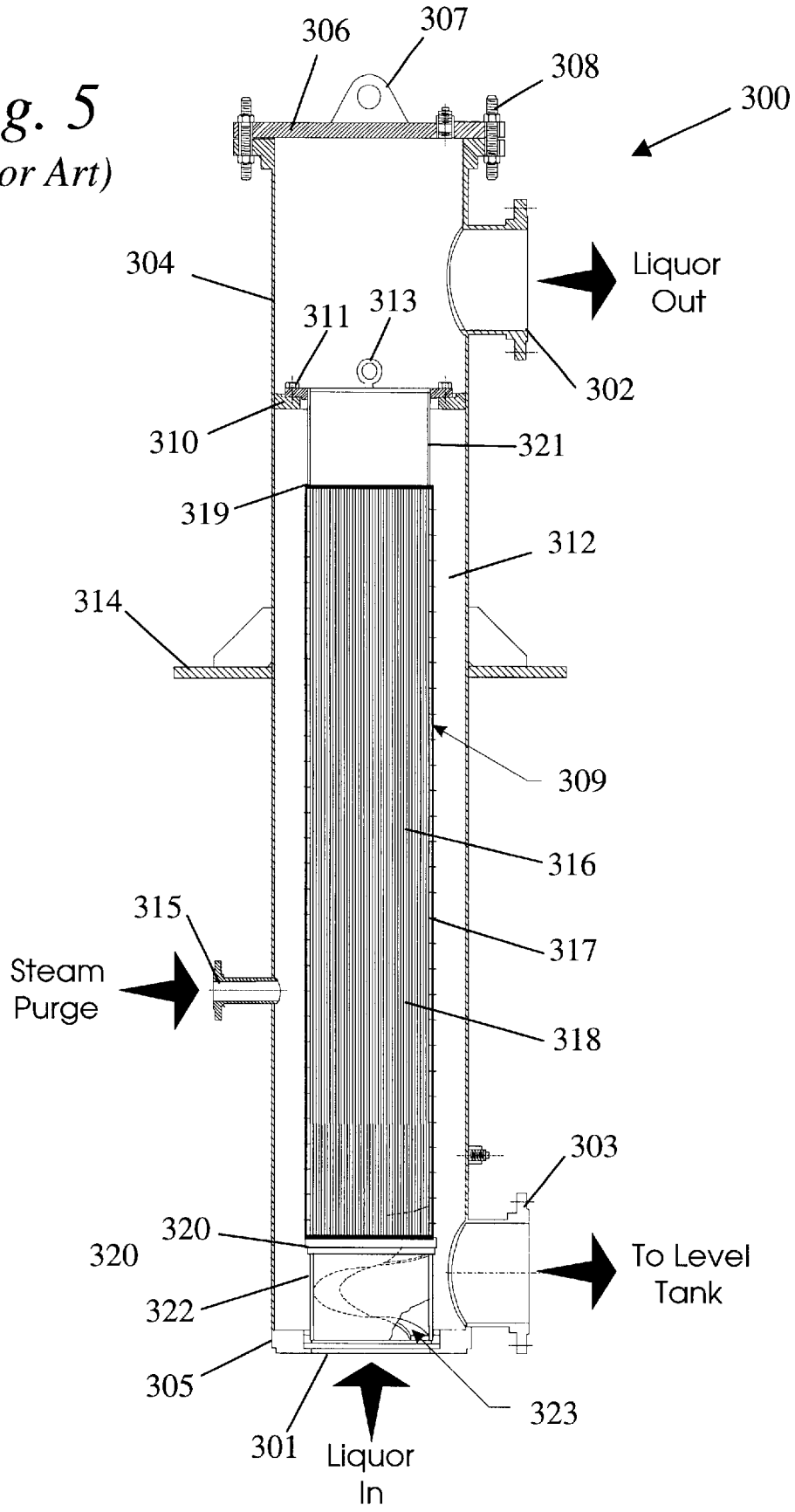
Fig. 5 (Prior Art)
FIG. 5 is a cross-sectional view of an exemplary prior art drainer that can be used in the practice of the present invention.

One example of a liquor separating device that can be used in the practice of the present invention or as item 37 of FIG. 2 is shown in FIG. 5. FIG. 5 illustrates a conventional In-line Drainer 300 as sold by Ahlstrom Machinery having an inlet 301 for a particulate-bearing liquid to be strained, an outlet 302 for liquid that has been strained, and an outlet 303 for the strained liquid. Drainer 300 includes a cylindrical housing 304, having a cover plate 305 at a first or inlet end having the inlet opening 301 and a second or outlet end having end cover plate 306. The cover plate 306 typically includes a lifting eye 307 and appropriate mounting hardware 308, for example, threaded studs and nuts. The drainer 300 includes a cylindrical screen basket 309 positioned in the housing 304. The upper end the screen basket 309 is mounted to the housing 304 by means of a annular mounting flange 310 on the housing and appropriate mounting hardware 311, for example, threaded screws. The lower end of the screen basket 309 is snugly fit into a machined surface in the inlet 301. The screen basket 309 is positioned in the housing 304 so that an annular cavity 312 is created between the outside surface of the screen basket 309 and the inside surface of the housing 304. The screen basket 309 may also include a lifting eye 313 for removing the basked for replacement or servicing. The housing 304 also typically includes a gusseted mounting flange 314 for installing the drainer in the desired location and a steam purge inlet 315 for introducing steam for periodic steam cleaning of the drainer.

Though the centerline of the outlet 302 shown in FIG. 5 is positioned at a right angle to the centerline of the housing 304, the outlet 302 may also positioned in the top plate 306 so that its centerline is essentially collinear with the centerline of the housing. An outlet collinear with the centerline of the housing, and thus with the direction of flow, may be more desirable when the invention is used in the systems shown in FIGS. 3 and 4, that is, where the concentration of cellulose material is greater and abrupt changes in flow direction can cause undesirable flow restrictions and stagnation. The right-angled outlet orientation shown in FIG. 5 is preferred when the drainer 300 is used as shown by item 37 in FIG. 2.

In the conventional drainer 300 shown in FIG. 5, the screen basket 309 is fabricated from a series of evenly-spaced vertical bars 316 supported by a series of external annular rings 317 so that a straining surface is provided having a series of vertical slots 318 between the bars 316. The bars 316 are typically welded to the rings 317 and to support rings 319 and 320 located at either end of the basket. The screen basket 309 also typically includes unperforated cylindrical sections 321 and 322 at each end of the screen basket 309.

According to the prior art shown in FIG. 5, the lower cylindrical section 322 of the basket 309 includes a helical baffle 323, which is typically referred to as the "flight". As discussed above, this flight 323 induces a helical flow to the liquid introduced under pressure to inlet 301 so that the orientation of any chips, pins or fines that may be present in the slurry is less likely to be aligned with the vertical slots of the screen basket 309.

The device shown in FIG. 5 operates as follows. A pressurized flow of liquid, typically containing at least some wood chips, pins, or fines, or a slurry of liquid and chips, is introduced to the inlet 301 of the drainer 300. When used as item 37 in FIG. 2, the liquid typically has a pressure ranging from about 0 to about 5 bar gage. When used as item 153 or 154 of FIG. 3 or item 254 of FIG. 4, the pressure of the slurry introduced to the inlet 301 typically ranges from about 0 to about 30 bar gage. The design of the housing 304 and basket 309 will vary depending, among other things, upon this pressure. The helical baffle 323 imparts a tangential velocity component to this liquid flow so that the flow through the screen basket 309 is somewhat helical. As the liquid passes through the cylindrical screen basket 309 at least some liquid passes through the apertures, that is, the slots 318, of the screen 309, collects in annular cavity 312, and is discharged out of outlet 303. The liquid from outlet 303 can be forwarded to any appropriate location but is typically forwarded to Level Tank 39 when used in a feed system, as in FIG. 2, or can be recirculated as shown in FIGS. 3 and 4. The liquid and chips, fines, and pins and other material which do not pass through the screen basket 309 continue to and are discharged from the outlet 302. When used as item 37 in FIG. 2, the liquid discharged from outlet 302 is typically passed to a conduit leading to the inlet of a High-pressure Feeder, such as a Chip Tube (item 18 in FIG. 2), Chip Chute, or Liquor Surge Tank (item 45 in FIG. 2). When used as item 153 or 154 of FIG. 3 or item 254 of FIG.

4, the liquid discharged from outlet 302 is typically passed to a High-pressure Feeder (item 126 in FIG. 3), or to a digester (via conduit 131 in FIG. 3 or via conduit 260 in FIG. 4).

The slot width and slot spacing will typically be a function of the content of the slurry passing through the drainer 300 and the desired pressure drop across the slots 318. In the conventional use of the device 300, for example, as used to treat a low-solid concentration slurry with smaller particles, as in as item 37 in FIG. 2, the slot 318 width may vary from between about 1 to 4 mm and the slots 318 are typically evenly spaced by about 2 to 6 mm. In the application of the present invention, for example, shown by item 153 or 154 in FIG. 4, when treating a slurry having a higher solid concentration with larger particles, the slot 318 width will typically vary between about 4 and 8 mm and typically be uniformly spaced by about 3 to 7 mm.

In the prior art device 300 shown in FIG. 5, the helical baffle 323 which induces a helical flow to the slurry or liquid passing through the drainer, in some instances, can produce an undesirable pressure drop across the drainer. According to the present invention, this baffle or flight 323 and the restriction to flow, or pressure drop, it can create are eliminated. Though this baffle or flight 323 may be used in conjunction with the obliquely oriented slots 318 of the present invention, it is preferred that this baffle or flight 323 be eliminated.

Figure 6:
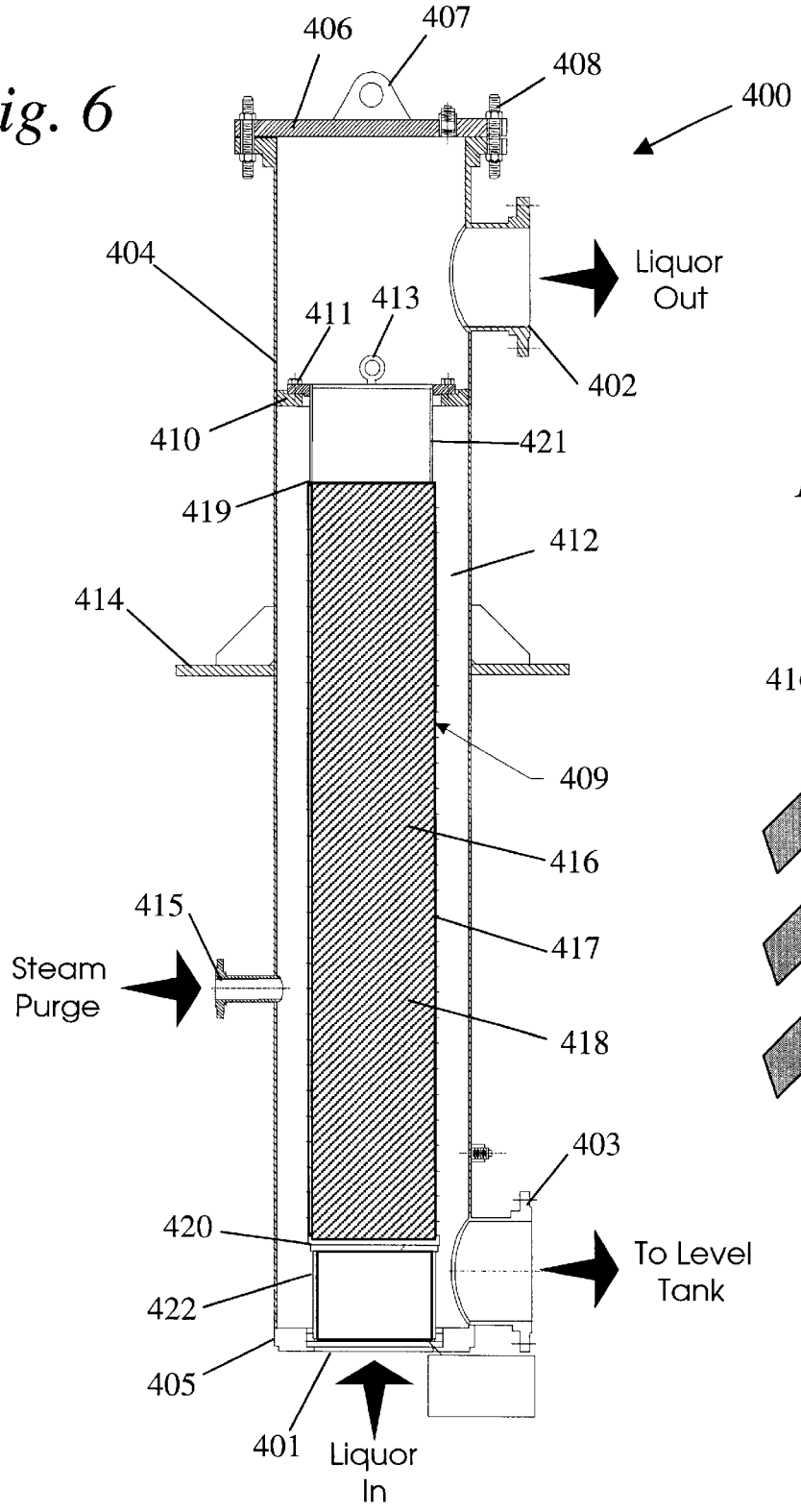
FIG. 6 is a cross-sectional view, similar to FIG. 5, of another embodiment of drainer that can be used according to the present invention.
Figure 7:
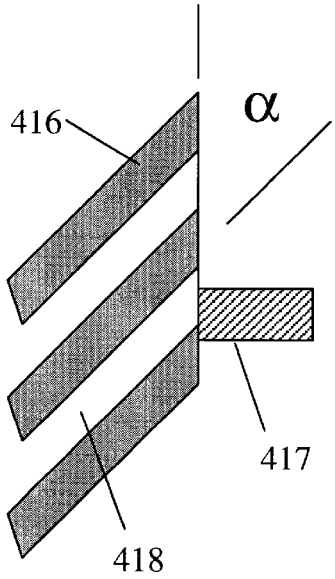
FIG. 7 is a detailed view of the screen basket of the drainer of FIG. 6.
Figure 8:
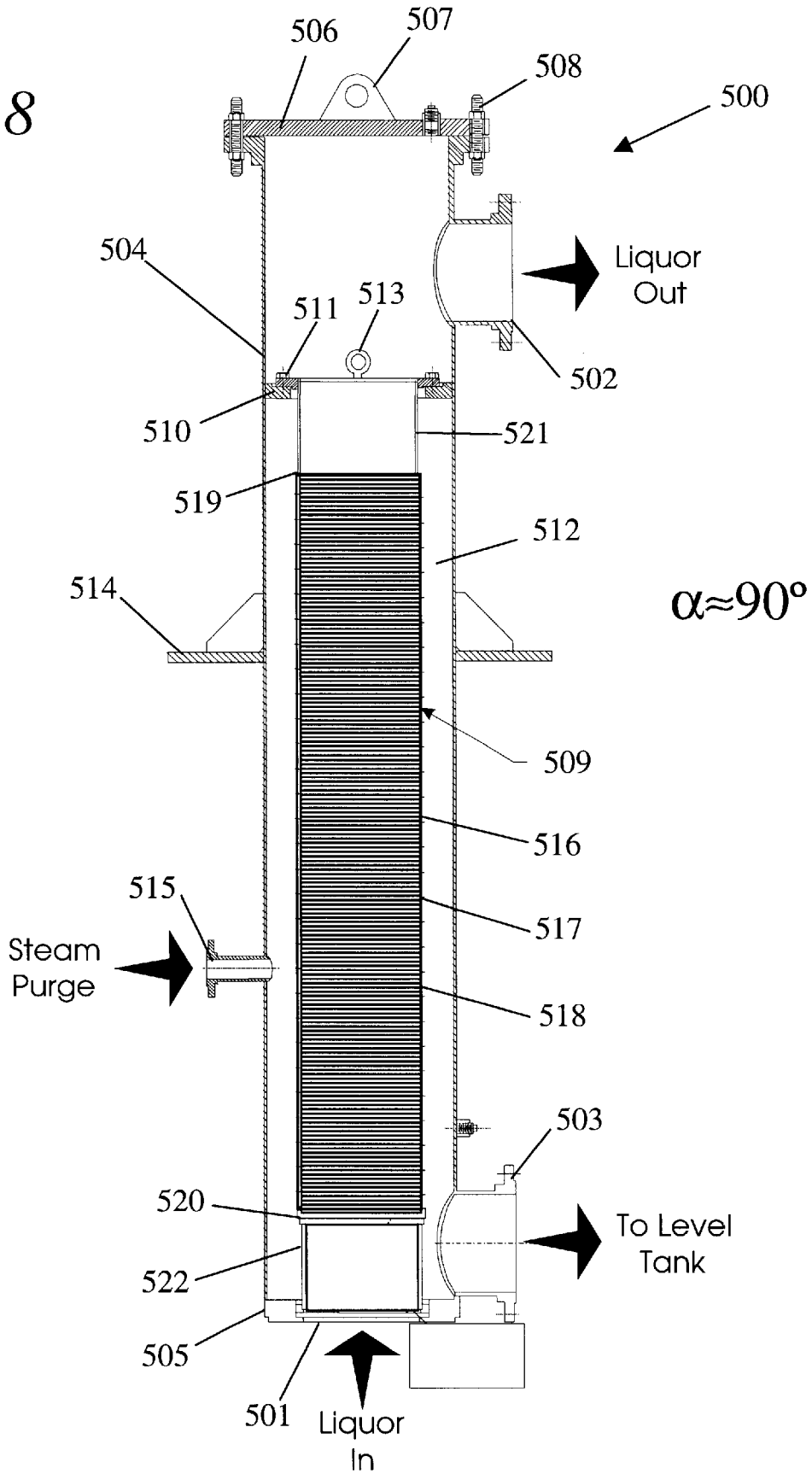
FIG. 8 is cross-sectional view of another embodiment of a drainer that can be used according to the invention.

Two embodiments of the present invention are shown in FIGS. 6, 7 and 8. The items in FIGS. 6, 7, and 8 that are essentially identical to those found in FIG. 5 are identified by the same reference numbers. The distinctions between the prior art and the present invention are identified by the same two digit reference numerals but are prefaced by the numerals "4" and "5", respectively, instead of by the numeral "3" as shown in FIG. 5.

FIG. 6 illustrates one embodiment of the present invention in which the screen basket slots are oriented obliquely to the direction of elongation of the housing. First, note that the "flight", item 323 in FIG. 5, has been eliminated in FIG. 6. That is, the inlet 301 is substantially devoid of any flow director or impediment, i.e., is substantially completely hollow. In addition, according to the present invention, in the screen basket 409 of FIG. 6, the slots 418 formed by bars 416 and supported by annular rings 417, are oriented at an oblique angle $\alpha$ to the direction of elongation of the screen basket 409 and the direction of elongation of the cylindrical housing 404 so that slots 418 are also oriented at an angle $\alpha$ to the direction of flow of liquid through the screen basket 409. This is more clearly shown in the detail schematic of FIG. 7.

FIG. 7 illustrates a detailed cross-section of a partial view of the screen basket 409. Though the angle $\alpha$ shown in FIG. 7 is illustrated at a preferred orientation of the slots 418 of approximately 45°, it is to be understood that according to this invention the angle $\alpha$ may range from plus or minus 5° to plus or minus 90° from the direction of elongation of the housing 404. For example, in the embodiment of FIG. 8, the angle $\alpha$ is approximately plus 90°, that is, if the housing 404 is vertically elongated, the slots 518 are essentially horizontal. Again, in FIG. 8, the helical baffle 323 shown in FIG. 5 is eliminated. All other features of FIGS. 6 and 8 are essentially the same as FIG. 5.

Though the embodiments shown in FIGS. 6, 7, and 8, illustrate parallel bar type construction, the present invention also includes machined-plate type construction. For example, the slots 418, 518, either continuous or discontinuous, may be fabricated from metal plate by any appropriate machining means including, but not limited to, water-jet cutting, laser cutting, EDM machining, drilling, milling, or any other conventional method of producing apertures in plate.

Also, the slots 418, 518 may be continuous slots or they may be discontinuous slots interrupted by unperforated "land" areas. These land areas may be uniformly distributed throughout the screen basket 409, 509 so that a uniform pattern of slots and land areas is established or the slots and land areas may be distributed non-uniformly. The orientation of the slots may also vary, for example, the angle of orientation of the slots 418, 518 at one elevation in the direction of elongation of the screen basket may be different from the orientation of the slots at second or an adjacent elevation. The orientation of slots at one elevation in the direction of elongation of the screen basket may also vary, for example, producing a "herring bone"-type pattern of slots. The angle $\alpha$ of the slots may also vary from one elevation to another or adjacent elevation or the angle $\alpha$ of the slots may vary within a given elevation.

The slots 418, 518 of the screen basket 409, 509 are preferably uniformly spaced and have a width of between about 1 to 20 mm and a distance between slots 418, 518 that may vary from about 1 to 20 mm, depending upon the slurry treated by the drainer 400, 500 and the desired pressure drop across the slots 418, 518 . When used as item 37 in FIG. 2, the slurry being treated will typically have a relatively lower concentration of cellulose material and the slots 418, 518 will have a width of about 0.5 to 10 mm, typically about 1 to 6 mm, preferably about 2 to 4 mm, and a distance between slots will be about 1 to 10 mm, typically about 1 to 6 mm, preferably about 3 to 4 mm. When used as item 153 or 154 of FIG. 3 or item 254 of FIG. 4, the slurry being treated typically will have a relatively higher concentration of cellulose material and the slots 418, 518 will have a width of about 0.5 to 15 mm, typically about 3 to 9 mm, preferably about 5 to 7 mm and a distance between slots of about 1 to 10, typically about 2 to 8 mm, preferably about 4 to 6 mm.

The invention shown in FIGS. 6, 7, and 8 can be used in any desired location where liquid separation from a slurry of liquid and cellulose material is desired. The invention shown in FIGS. 6, 7, and 8 may be used in a feed system for a digester, for example, as the device 37 in the feed system shown in FIG. 2 herein. The invention shown in FIGS. 6, 7, and 8 may also be used for treating slurries being handled by a High-pressure Feeder or being fed to a digester, either continues or batch, as shown as item 153 or 154 of FIG. 3 or item 254 of FIG. 4.

The present invention provides a more effective system and method of introducing a slurry of comminuted cellulosic fibrous material to a treatment vessel. Unlike the prior art, the present invention is not limited to the solids transfer capacity of the pumping device. The present invention can transfer more material and less liquid so that more material can be introduced and treated per unit time than as in prior art systems, or the size and cost of the feed system reduced. As described above, the present invention also has various other benefits compared to the prior art.

While the invention has been described in connection with what is presently considered to be the most practical and preferred embodiment, it is to be understood that the invention is not to be limited to the disclosed embodiment, but on the contrary, is intended to cover various modifications and equivalent arrangements and methods included within the spirit and scope of the appended claims.

What is claimed is:

1. A method of feeding a slurry of comminuted cellulosic fibrous material to a treatment vessel comprising:

a) slurrying a comminuted cellulosic fibrous material with a slurrying liquid to produce a slurry of the comminuted cellulosic fibrous material and liquid having a first liquid-to-material volume ratio;

b) pressurizing the slurry to a first pressure and transferring the slurry pressurized at said first pressure to a high-pressure transfer device;

c) introducing the slurry pressurized at said first pressure into the high-pressure transfer device;

d) in the high-pressure transfer device, pressurizing the slurry to a second pressure, higher than the first pressure;

e) transferring the slurry pressurized at said second pressure from the high-pressure transfer device to a treatment vessel;

f) introducing the slurry pressurized at said second pressure and transferred from the high-pressure transfer device into the treatment vessel; and g) removing at least some of the liquid from the slurry between a) and c) so that the slurry introduced to the high-pressure transfer device in c) has a second liquid-to-material volume ratio lower than the first liquid-to-material volume ratio.

2. A method as recited in claim 1 wherein at least some of the liquid removed during g) is used as at least some of the slurrying liquid in a).

3. A method as recited in claim 1 wherein g) is practiced immediately prior to step c).

4. A method as recited in claim 1 further comprising h) treating the material in the treatment vessel to produce cellulose pulp.

5. A method as recited in claim 1 wherein a) is practiced so that the first liquid-to-material volume ratio is about 2.50:1 or greater.

6. A method as recited in claim 5 wherein a) is practiced so that the first liquid-to-material volume ratio is about 3.0:1 or greater.

7. A method as recited in claim 1 wherein a) and g) are practiced so that the second liquid-to-material volume ratio is at least 0.25 less than the first liquid-to-material volume ratio.

8. A method as recited in claim 6 wherein a) and g) are practiced so that the second liquid-to-material ratio is at least 0.50 less than the first liquid-to-material ratio.

9. A method of feeding a slurry of comminuted cellulosic fibrous material to a treatment vessel comprising:

a) slurrying comminuted cellulosic fibrous material with a slurrying liquid to produce a slurry of the comminuted cellulosic fibrous material and liquid having a first liquid-to-material volume ratio;

b) pressurizing the slurry to a first pressure and transferring the slurry pressurized at said first pressure to a high-pressure transfer device;

c) introducing the slurry pressurized at said first pressure into the high-pressure transfer device;

d) in the high-pressure transfer device, pressurizing the slurry to a second pressure, higher than the first pressure, using a pressurized liquid, to produce a slurry of liquid having a second liquid-to-material volume ratio, higher than the first liquid-to-material volume ratio;

e) discharging the slurry having the second liquid-to-material volume ratio from the high-pressure transfer device;

f) transferring the slurry pressurized at said second pressure from the high pressure transfer device to a treatment vessel;

g) introducing the slurry pressurized at said second pressure into the treatment vessel; and h) removing at least some of the liquid from the slurry between e) and g) so that the slurry introduced to the treatment vessel in g) has a third liquid-to-material volume ratio lower than the second liquid-to-material volume ratio.

10. A method as recited in claim 9 wherein at least some of the liquid removed during h) is used as the pressurized slurrying liquid of d).

11. A method as recited in claim 9 wherein at least some of the liquid removed during h) is used as the slurrying liquid in a).

12. A method as recited in claim 9 wherein h) is performed substantially immediately after e).

13. A method as recited in claim 9 further comprising i) treating the material in the treatment vessel to produce cellulose pulp.

14. A method as recited in claim 9 wherein h) is performed prior to g) so that a slurry having a third liquid-to-material volume ratio is introduced to the treatment vessel; and further comprising i) removing excess liquid from the slurry during or shortly after the practice of g).

15. A method as recited in claim 14 further comprising j) combining the liquids removed at g) and i) and using at least some of the combined liquids as the pressurizing medium in d).

16. A method as recited in claim 15 further comprising k) monitoring the temperature of the combined liquids and l) regulating the flow of the liquids in h) and i) so that the temperature of the combined liquid is maintained below a specified value.

17. A method as recited in claim 9 wherein a) is practiced so that the first liquid-to-material volume ratio is about 2.50:1 or greater.

18. A method as recited in claim 17 wherein a) is practiced so that the first liquid-to-material volume ratio is about 3.0:1 or greater.

19. A method as recited in claim 9 wherein h) is practiced so that the third liquid-to-material volume ratio is at least 0.25 less than the second liquid-to-material volume ratio.

20. A method as in claim 18 wherein h) is practiced so that the third liquid-to-material ratio is at least about 0.50 less than the second liquid-to-material ratio.

21. A method as recited in claim 20 further comprising, between a) and c), removing some of the liquid from the slurry so that the liquid introduced into the high pressure device has a fourth liquid to material ratio at least about 0.25 less than the first ratio.

* * * * *